US007587153B2

(12) United States Patent
Jeon

(10) Patent No.: US 7,587,153 B2
(45) Date of Patent: Sep. 8, 2009

(54) COOLING DEVICE AND IMAGE FORMING APPARATUS HAVING THE SAME INSTALLED THEREIN

(75) Inventor: In-cheol Jeon, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 357 days.

(21) Appl. No.: 11/591,459

(22) Filed: Nov. 2, 2006

(65) Prior Publication Data

US 2007/0183808 A1 Aug. 9, 2007

(30) Foreign Application Priority Data

Feb. 6, 2006 (KR) ..... 10-2006-0011233

(51) Int. Cl.
*G03G 21/20* (2006.01)

(52) U.S. Cl. ..... 399/92

(58) Field of Classification Search ..... 399/92, 399/91

See application file for complete search history.

(56) References Cited

U.S. PATENT DOCUMENTS

| | | | | |
|---|---|---|---|---|
| 4,695,151 | A * | 9/1987 | Watanabe | 399/92 |
| 6,141,512 | A * | 10/2000 | Nagano et al. | 399/92 |
| 6,501,922 | B2 * | 12/2002 | Ihara et al. | 399/92 |
| 6,522,847 | B2 * | 2/2003 | Nanjo | 399/92 |
| 6,922,537 | B2 * | 7/2005 | Iikawa et al. | 399/92 |
| 7,031,632 | B2 * | 4/2006 | Deguchi et al. | 399/92 |
| 7,286,784 | B2 * | 10/2007 | Tanaka | 399/92 |
| 7,305,201 | B2 * | 12/2007 | Kimura | 399/92 |
| 2002/0089582 | A1 | 7/2002 | Chikano | |

FOREIGN PATENT DOCUMENTS

| | | |
|---|---|---|
| JP | 4-366676 | 12/1992 |
| JP | 6-15870 | 1/1994 |
| JP | 7-117315 | 5/1995 |
| JP | 7-148947 | 6/1995 |
| JP | 7-178932 | 7/1995 |
| JP | 2001-138548 | 5/2001 |
| JP | 2004-37685 | 2/2004 |
| JP | 2005-17939 | 1/2005 |

OTHER PUBLICATIONS

Office Action issued on Apr. 27, 2007 by the Korean Intellectual Property Office for Korean Patent Application No. 2006-11233.
Search Report issued in European Patent Application No. 06125018.9 on May 9, 2007.

* cited by examiner

*Primary Examiner*—Susan S Lee
(74) *Attorney, Agent, or Firm*—Stein McEwen, LLP

(57) ABSTRACT

A cooling unit for use with an image forming apparatus including an image development part, with an Organic photoconductor, which is installed inside the housing and which forms an image, a laser scanning unit which scans the surface of the Organic photoconductor, and a fuser assembly which fixes the image transmitted from the image development part at a high temperature and a high pressure. The cooling unit cools the laser scanning unit and image development part, and includes a fan, which generates airflow at the time of operation, a support frame to support the laser scanning unit, and a guide member, disposed on the support frame, which guides the airflow towards the laser scanning unit and the image development part.

40 Claims, 5 Drawing Sheets

COOLING DEVICE AND IMAGE FORMING APPARATUS HAVING THE SAME INSTALLED THEREIN

CROSS-REFERENCE TO RELATED APPLICATION

This application claims the benefit of Korean Patent Application No. 2006-11233, filed Feb. 6, 2006, in the Korean Intellectual Property Office, the disclosure of which is incorporated herein by reference.

BACKGROUND OF THE INVENTION

1. Field of the Invention

Aspects of the present invention relate to a cooling device, which cools an image development cartridge and laser scanning unit used in forming images on print media, and an image forming apparatus having the same installed therein.

2. Description of the Related Art

Photocopiers, printers, multifunction apparatuses and similar image forming apparatuses may be broadly divided into color image forming apparatuses and black-and-white image forming apparatuses. The advantages of black-and-white image forming apparatuses compared to other image forming apparatuses are that they are generally smaller and provide faster printing speeds.

Generally in black-and-white image forming apparatuses, the print medium (i.e., paper, transparency, etc.) is moved from the paper supply tray by the pick-up roller and follows a predetermined course past an organic photoconductive (OPC drum), on the surface of which the image is formed, and a transfer roller rotating while facing the Organic photoconductor. The image formed on the Organic photoconductor is transferred to the print medium as it passes between the transfer roller and the Organic photoconductor. The print medium, on which the image is printed, then passes through a fuser assembly, where the image is fused to the surface of the print medium by an application of high temperatures and pressures. The print medium is then either discharged from the main body of the image forming apparatus, or is sent back through the main body of the image forming apparatus, via a duplex printing path, so that printing on the other side of the printing medium may occur.

The fuser assembly comprises a heating roller maintained at a high temperature, and a pressure roller, which presses the heating roller with high pressure while rotating. A fuser assembly with this structure maintains a high temperature both in a printing mode thereof and a warming-up mode thereof, and, consequently, emits heat for a long period. As a result, other components in the image forming device, such as the Organic photoconductor and the laser scanning unit, also heat up due to the heat emitted by the fuser assembly.

The Organic photoconductor is installed in the development cartridge inside the printer housing, and comprises a photosensitive layer on a surface thereof, which is sensitive to heat. Therefore, in general, the Organic photoconductor is unable to maintain a constant temperature due to the heat which the Organic photoconductor itself produces during operation, and the heat generated by the fuser assembly. In this situation, normal printing quality cannot be ensured.

Furthermore, structural limitations resulting from the Organic photoconductor being installed on the inside of the development cartridge, surrounded by a charging member, a cleaning blade, and a developer roller, render natural cooling of the Organic photoconductor difficult.

Moreover, the laser scanning unit to scan the Organic photoconductor is usually installed on top of the image development part, which comprises the Organic photoconductor. Generally, the laser scanning unit comprises a light source, a polygonal mirror, a spindle motor and a plurality of optical members. It is important to isolate or reduce the heat generated from the fuser assembly, as a minute change in the location or dimensions of laser scanning units, caused by the rise in temperature, may have a significant effect on the precision of components used in scanning the Organic photoconductor.

Taking the above factors into consideration, development of an apparatus that effectively cools down the laser scanning unit and the image development part is acutely needed.

SUMMARY OF THE INVENTION

Aspects of the present invention provide a cooling apparatus with a structure developed in order to cool both the laser scanning unit and the image development part, and an image forming apparatus having the cooling apparatus installed therein to alleviate the above and/or other problems.

According to aspects of the cooling apparatus of the present invention, the cooling apparatus is a cooling unit, which cools the laser scanning unit and the image development part. The image forming apparatus comprises an image development part, which transfers the image to the print medium; a laser scanning unit, which scans the surface of the organic photoconductor; and a fuser assembly, which fixes the image transferred from the organic photoconductor on the print medium. The cooling apparatus of the present invention comprises a fan, which generates airflow at the time of operation thereof; a support frame, installed inside the printer housing, to support the laser scanning unit; and a guide member, which guides the air generated by the fan towards the laser scanning unit and the image development part.

The guide member may be formed integrally with the support frame. The support frame may be disposed between the laser scanning unit and the fuser assembly. The fan may be installed on one side of the support frame in order to move the air towards the opposite side of the support frame.

The guide member may comprise a plurality of support ribs, disposed at predetermined intervals along the length of the support frame, which guide the airflow generated by the fan towards the image development cartridge and the laser scanning unit. The guide ribs may vary in length. The guide ribs may have curved surfaces to allow for efficient guiding of the air. The degree of curvature of the guide surfaces may vary.

The support frame may have an opening between an upper and a lower plate, and the guide ribs may be disposed perpendicularly at predetermined intervals around the opening in order to guide the airflow through the opening towards the image development part. The upper plate of the support frame may be formed with a smaller surface area than the lower plate, so the airflow generated by the fan may be directed towards the laser scanning unit. The guide ribs positioned the farthest from the fan may be longer than the other guide ribs. The guide ribs which are longer than the other guide ribs may also be inclined at a greater angle relative to the support frame than the other guide ribs.

The image forming apparatus of the present invention, in order to achieve the objectives listed above, comprises an image development part installed on the main body, with an organic photoconductor; a laser scanning unit to scan the organic photoconductor; a fuser assembly to fix the image to the print medium; and a cooling unit to cool the laser scanning unit and the image development part.

The cooling unit may be installed between the laser scanning unit and the fuser assembly.

The cooling unit may comprise a fan, installed inside the printer housing, which generates airflow at the time of operation; a support frame installed in the housing, which supports the scanning unit; and a guide member, disposed on the support frame, to guide the airflow generated by the fan towards the laser scanning unit and the image development part.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
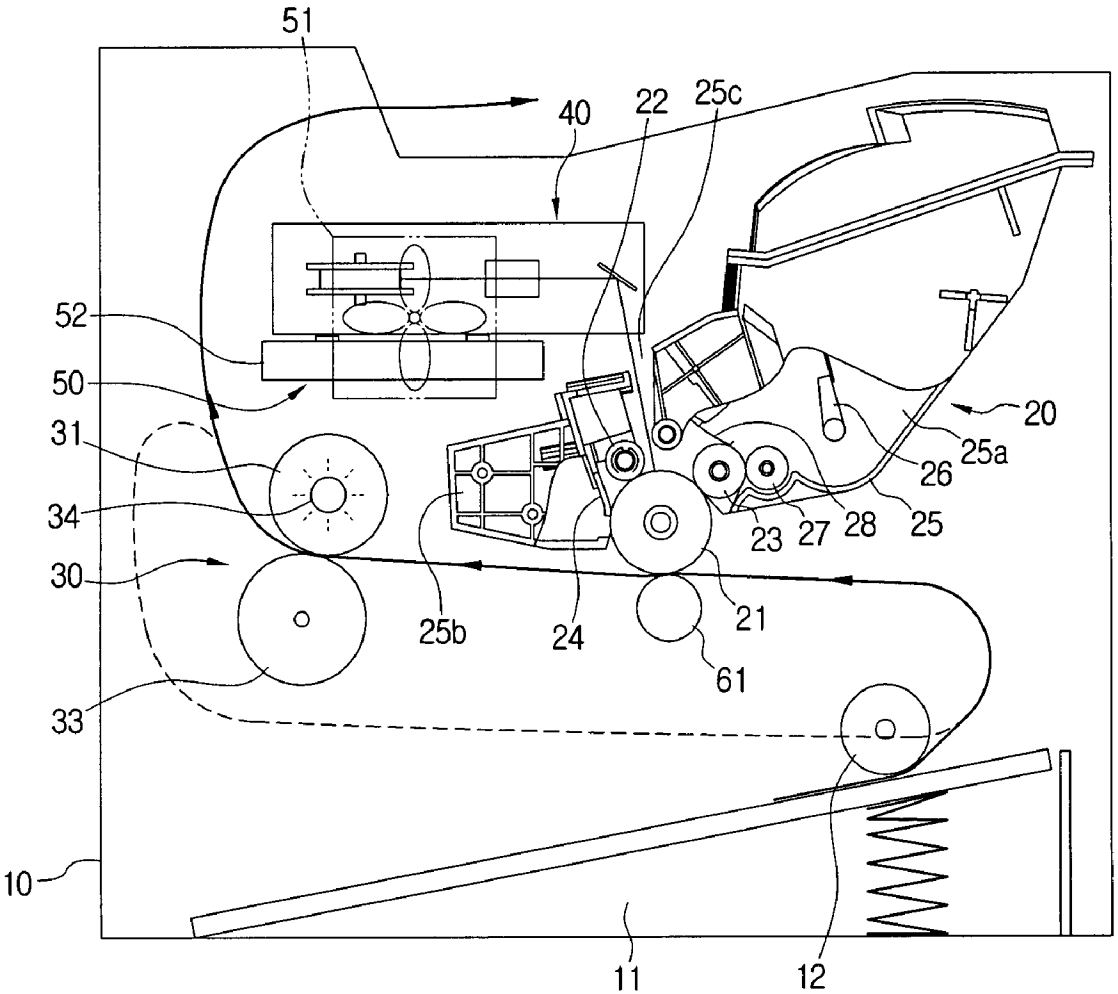
FIG. 1 is a cross-sectional diagram showing schematically the image forming apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

As shown in FIG. 1, the image forming apparatus according to an embodiment of the present invention comprises a housing 10, a image development part 20 installed inside the housing 10, which prints the image onto the print medium (i.e., paper, transparency, etc.), a fuser assembly 30, which fixes the image onto the print medium after the print medium has passed the image development part 20, by an application of high temperature and high pressure; a laser scanning unit 40, and a cooling unit 50.

A paper supply tray 11 is installed at a bottom of the housing 10. The print medium is picked up by the pick-up roller 12 from the paper supply tray 11, and is then moved toward the image development part 20 by an operation of a plurality of paper feed rollers (not displayed).

The image development part 20 prints an image onto the print medium, and comprises an organic photoconductive cartridge (Organic photoconductor) 21, a charge roller 22, which projects a charge onto the Organic photoconductor 21, a developer roller 23, which provides the toner and other materials used in image development, and a cleaning member 24, which cleans the Organic photoconductor 21. The Organic photoconductor 21 is installed so as to rotate while remaining in contact with a transfer roller 61. When the print medium passes between the Organic photoconductor 21 and the transfer roller 61, the image formed on the Organic photoconductor 21 is transferred to the print medium.

The Organic photoconductor 21 is rotatably installed inside the housing 10 of the image development part, and is substantially completely held inside the casing 25. The surface of the Organic photoconductor 21 receives an electrical charge from the charge roller 22. The surface of the charged Organic photoconductor 21 is partially scanned by a laser beam emitted by the laser scanning unit 40. An electrostatic impression corresponding to the desired image is formed on the surface of the Organic photoconductor 21 by the laser scan. The toner materials provided by the developer roller 23 move onto the electrostatic impression area and a visible image forms.

The casing 25 may be divided into a first casing 25*a*, filled with new print material, and a second casing 25*b*, in which residual toner and other materials removed by the cleaning member 24 are stored. A mixer 26, which mixes the print materials, a print material delivery roller 27, and a print material volume regulating member 28 are each installed inside the first casing 25*a*. The Organic photoconductor 21 is disposed between the first case 25*a* and the second case 25*b*. One part of the Organic photoconductor 21 is scanned on an outside surface thereof, which contacts the transfer roller 61. The other part is exposed in order to be scanned with the laser beam of the laser scanning unit 40. The laser beam from the laser scanning unit 40 may be delivered to the Organic photoconductor 21 through an opening 25*c* in the top of the casing 25. The casing 25 is structured such that the casing 25 may be installed in the housing or removed from the housing 10. Consequently, if the lifespan of the Organic photoconductor 21 is reached, or the print materials are consumed, replacing the cartridge is possible.

Of course, it is understood that the image development part 20 may be designed with a diverse range of embodiments in mind in addition to the embodiments described above. However, since this may be easily understood from the related art, a more detailed description thereof has been omitted.

The fuser assembly 30 fixes the image transferred from the image cartridge onto the surface of the print medium by an application of high temperature and high pressure. To this end, the fuser assembly 30 comprises a heating roller 31 and a pressure roller 33. A heater, which heats the heating roller 31 to the high temperature, is installed inside the heating roller 31. Meanwhile, the pressure roller 33 is rotatably installed in the housing 10, and presses into the heating roller 31 as a result of a biasing force provided by a pressure member (not shown). Heaters can be installed inside both the heating roller 31 and the pressure roller 33, and the position of the heating roller 31 and the pressure roller 33 can be swapped. Because this kind of fuser assembly 30 maintains a high temperature both while warming up and while printing, it is the heat source that increases the temperature inside the housing 10.

Figure 2:
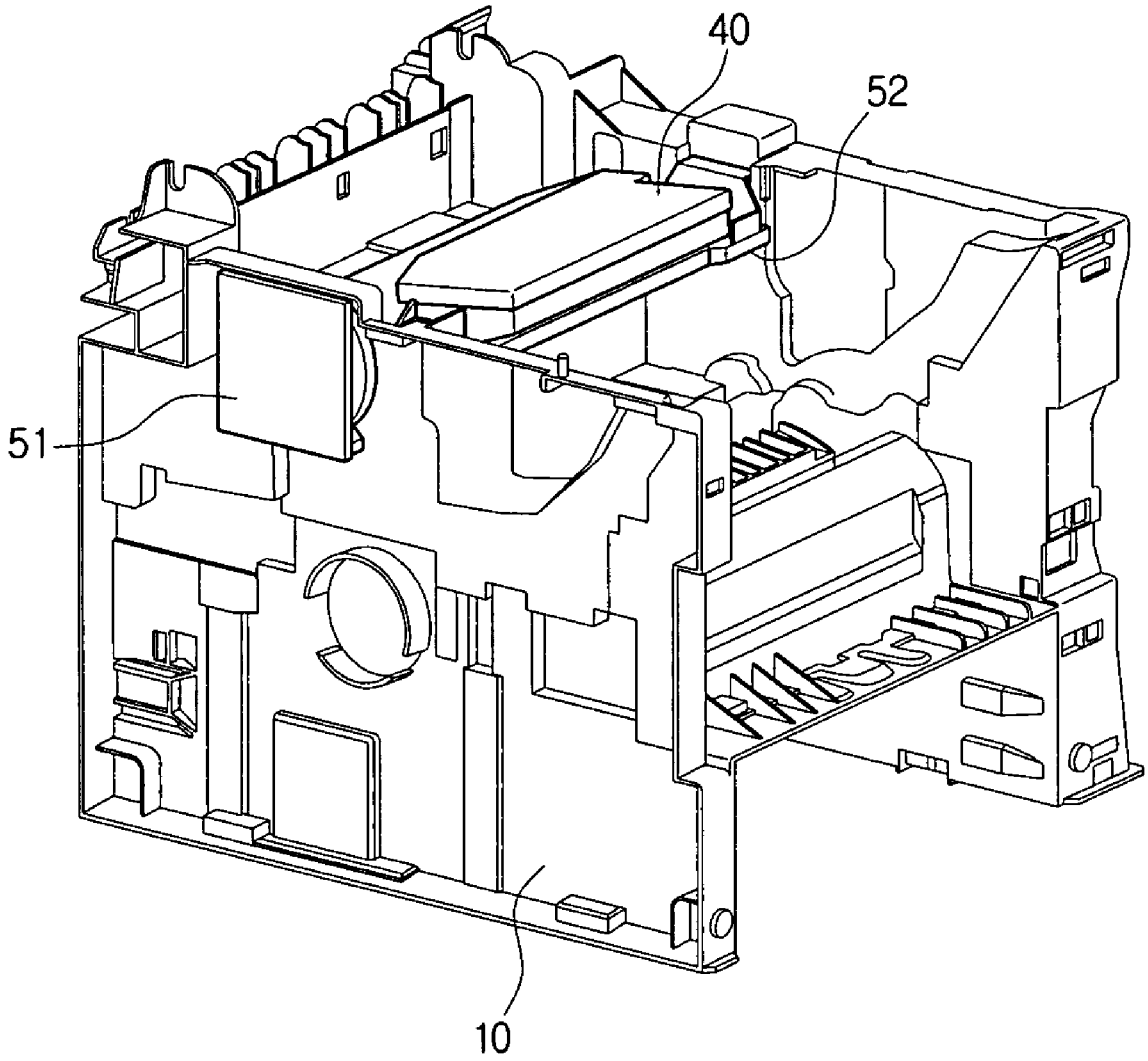
FIG. 2 is a perspective view schematically showing the image forming apparatus in which the laser scanning unit is supported by the support frame.

The laser scanning unit 40 is installed in the housing 10 and is designed to scan the Organic photoconductor 21. Specifically, the laser scanning unit 40 is disposed above the image development part 20 and the fuser assembly 30, as shown in FIG. 2, while being supported on the support frame 52, as described below. The laser scanning unit 40 is an optical apparatus comprising a laser diode, a polygonal mirror, and a plurality of optical members, and may be readily understood from the related art, so detailed description thereof is omitted.

Figure 3:
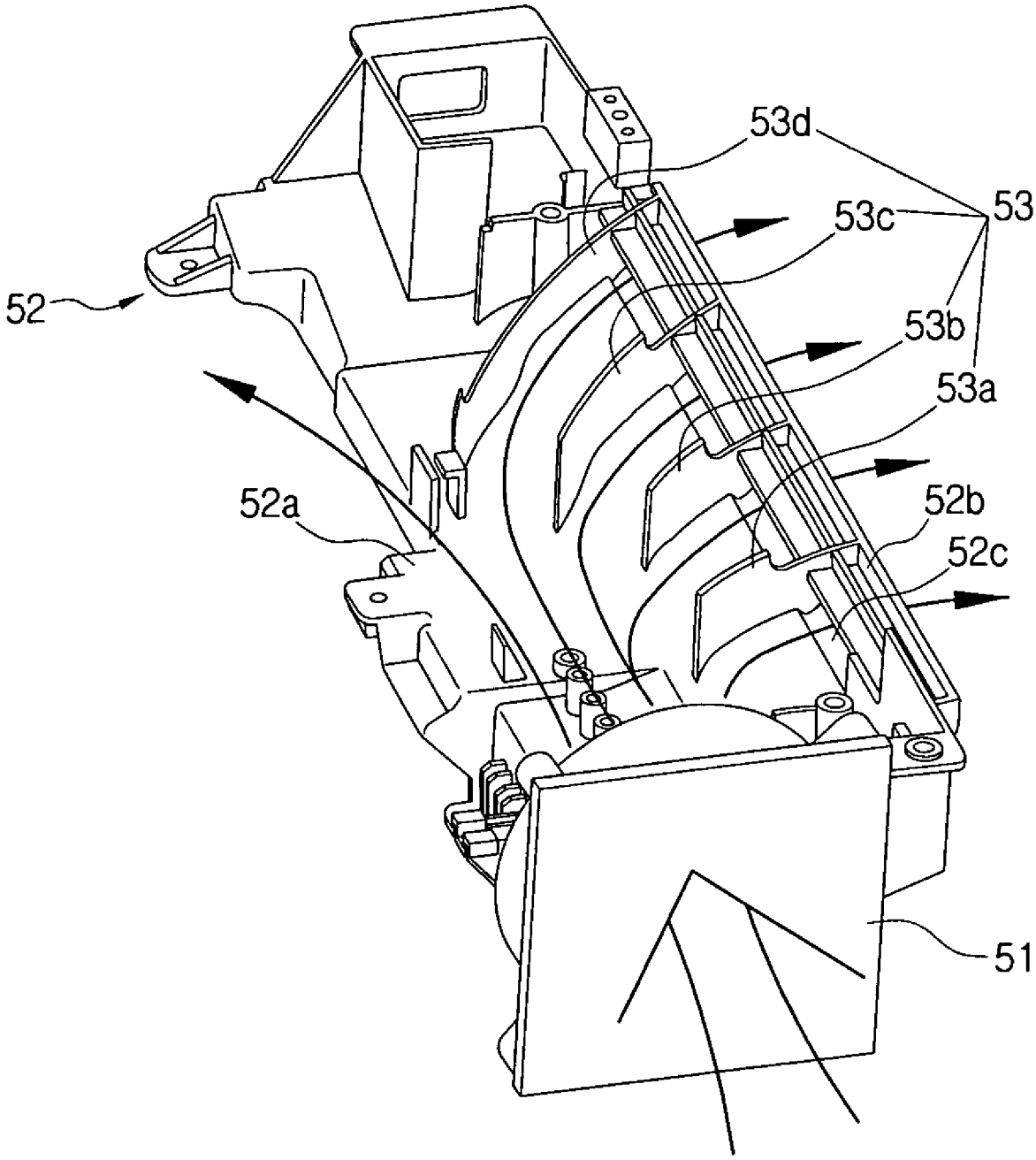
FIG. 3 is a perspective view showing only the support frame illustrated in FIG. 2.

The cooling unit 50 prevents the laser scanning unit 40 and the image development part 20 from overheating as a result of the heat generated by the fuser assembly 30. The cooling unit 50, as shown in FIGS. 2 and 3, comprises a fan 51 installed in the housing 10, a support frame 52, which supports the laser scanning unit 40, and a guide member 53, which is disposed on the support frame 52, and which guides the air moved by the fan 52 in the direction of the image development part 20 and the laser scanning unit 40. The fan 51 is disposed on one side of the support frame 52, and is positioned so as to move air towards the opposite side of the support frame 52.

The support frame 52 is connected to two or more sides of the housing 10, and supports the laser scanning unit 40. The support frame 52 is disposed between the fuser assembly 30 and the laser scanning 40, and prevents heat produced by the fuser assembly 30 from being directly transmitted to the laser scanning unit 40. The support frame 52 has a lower plate 52*a* and an upper plate 52*b*, and an opening 52*c* defined between the upper and lower plates. The upper plate 52*b* has a smaller surface area than the lower plate 52*a*. If the laser scanning unit 40 is disposed on the upper plate 52*b*, the laser scanning unit 40 is fastened to and supported by the upper plate 52*b* with screws or other fasteners.

The guide member 53 may be integrally formed with the support frame 52. The guide member 53 comprises a plurality of guide ribs 53*a*, 53*b*, 53*c*, 53*d* which are each disposed at predetermined intervals along the length of the support frame 52. The guide ribs 53*a*, 53*b*, 53*c*, 53*d* vary in length and in their angle of inclination according to their position along the support frame 52. In more detail, the guide ribs 53*d* located farthest from the fan 51 are longer than the guide ribs 53*a*, 53*b*, 53*c* located closer to the fan 51, and are inclined at a greater angle relative to the support frame 52. Also, the guide ribs 53*a*, 53*b*, 53*c*, 53*d* each have a guide surface of a predetermined curvature. The guide surface is formed in order to receive the oncoming airflow generated by the fan 51, and to then guide the airflow towards the opening 52*c*.

Figure 4:
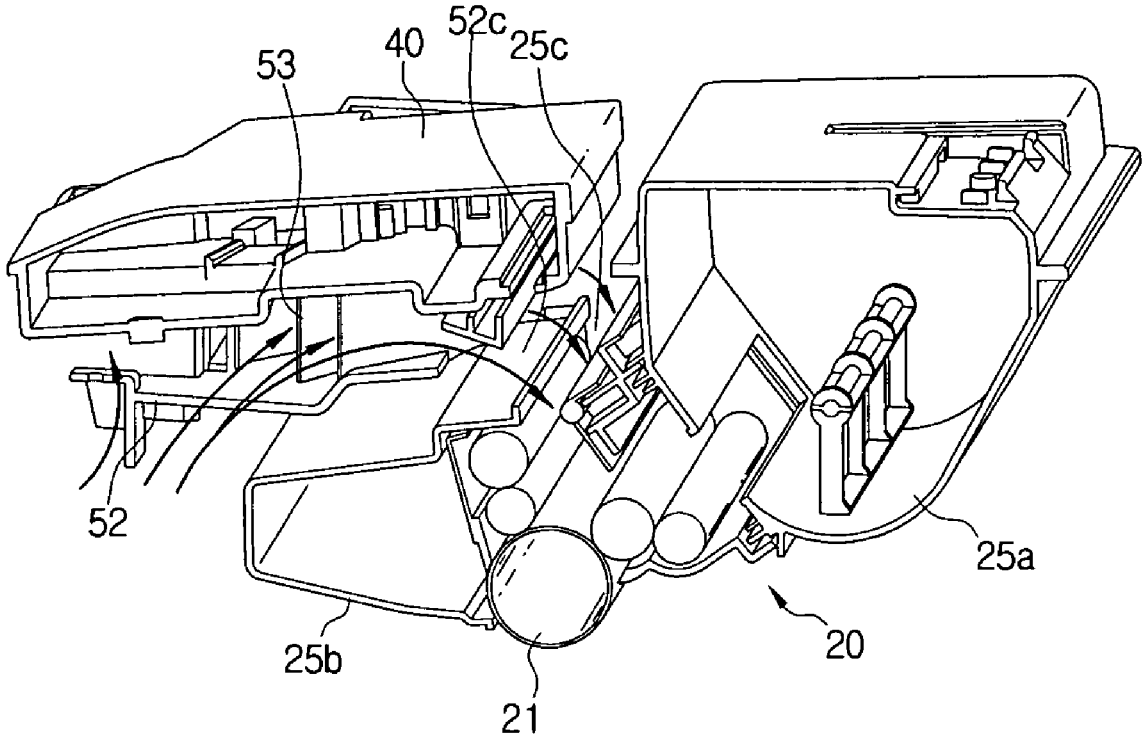
FIG. 4 is a sectional side view schematically showing the image forming apparatus in the state in which the airflow between the illustrated support frame and the laser scanning unit is guided towards the image development part.

If the image forming apparatus according to an embodiment of the present invention has the structure described above, air moved by the fan 51 travels towards the side of the support frame 52 opposite the fan 51. Most of the air moved by the fan 51 contacts the lower side of the laser scanning unit 40 directly, as shown in FIGS. 3 and 4. As a result, the laser scanning unit 40 is cooled first. Part of the airflow reflected from the bottom of the laser scanning unit 40 is guided by the guide ribs 53*a*, 53*b*, 53*c*, 53*d* through the opening 52*c*, and is directed towards the image development part 20 in order to secondarily cool the image development part 20. The air, which passes through the opening 52*c*, moves towards the top of the image development part 20 and cools the casing 25 of the image development part 20. A portion of this air moves inside the casing 25 and cools components inside the casing 25 of the image development part 20. For example, the portion of this air cools the print material volume regulating member 28 inside the casing 25 of the image development part 20.

Additionally, some of the air moved by the fan 51 is not guided by the guide members 53, but rather, travels in the opposite direction and causes the surrounding air to circulate, so that the temperature inside the housing 10 is distributed evenly.

Figure 5A:
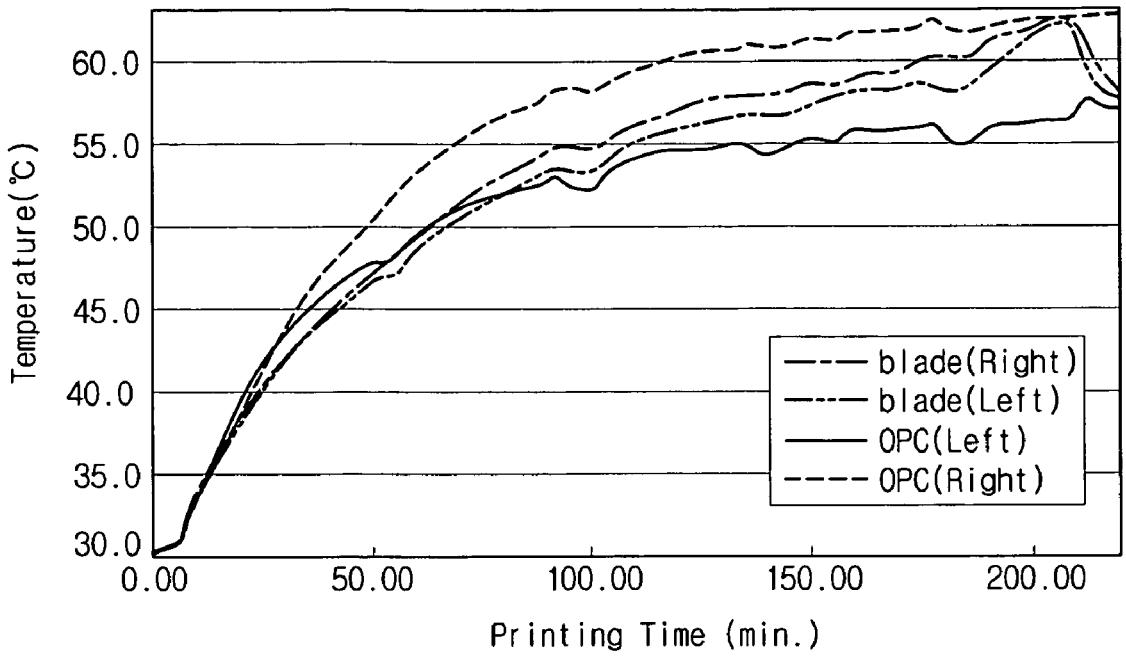
FIGS. 5A and 5B are graphs contrasting the temperature before and after the installation of the guide member on the support frame, based on experiments.

FIG. 5A is a graph showing measurements over time of the temperature change inside the housing 10 while duplex printing (i.e., double-sided printing), is in progress, in the situation that guide members 53 are not present, and only the fan 51 is used.

Figure 5B:
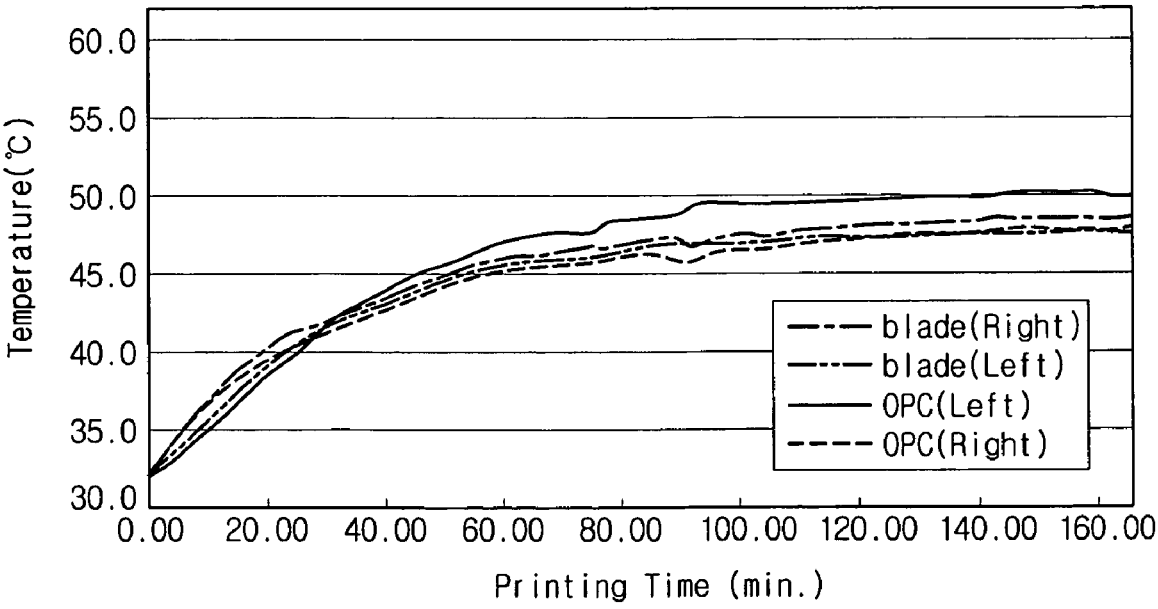

FIG. 5B is a graph showing measurements over time of the temperature change inside the housing 10 while the duplex printing is in progress, in an embodiment of the present invention furnished with guide ribs 53. In FIGS. 5A and 5B, the term, "OPC," refers to the Organic photoconductor 21, and the term, "blade," refers to the print material volume regulating member 28.

As may be seen in FIGS. 5A and 5B, if a guide member with the specific structure of the present invention is installed in an image forming apparatus, a drop in an internal temperature of the image forming apparatus of approximately 10 degrees Celsius on average compared to the temperature before the installation of the guide member may be realized. In this manner, the temperature inside the housing 10, particularly the temperature of the image development part 20, may be reduced, preventing a deterioration of the functioning of the Organic photoconductor and a deterioration of the printing quality as a result of the rise in temperature. As such, an increase in the printing quality may be realized.

By additionally cooling the laser scanning unit 40 using the ventilation, laser errors arising due to a change in the dimensions of the components caused by the rise in temperature may also be prevented.

According to the cooling apparatus and the image forming apparatus comprising the cooling apparatus, overheating of the laser scanning unit caused by heat from the fuser assembly may be prevented, by having the cooling unit disposed between the fuser assembly and the laser scanning unit.

Moreover, by providing a guide member on the support frame supporting the laser scanning unit, the airflow may be guided directly towards the image development cartridge. As a result of cooling the image development cartridge with the moved air in this manner, the temperature of the image development cartridge may be substantially lowered, and a deterioration of the printing quality caused by the high temperature may be prevented.

Also, the air inside the housing may be made to circulate, so the temperature inside the housing may be maintained at a relatively constant level.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cooling unit, to cool a laser scanning unit and an image development part of an image forming apparatus, the laser scanning unit being supported by a support frame, the cooling unit comprising:

a fan to generate an airflow within a housing during an operation of the apparatus; and a guide member, disposed on the support frame, to guide the airflow towards the laser scanning unit, and the image development part, wherein the fan is installed on one side of the support frame, and wherein the airflow proceeds from the one side of the support frame to the other.

2. The cooling unit according to claim 1, wherein the guide member comprises a plurality of guide ribs to guide the airflow.

3. The cooling unit according to claim 2, wherein the guide ribs have varying lengths.

4. The cooling unit according to claim 2, wherein each of the guide ribs includes a curved guide surface to guide the air.

5. The cooling unit according to claim 4, wherein the guide surfaces have varying degrees of curvature.

6. The cooling unit according to claim 2, wherein an opening between an upper plate and a lower plate of the support frame is defined, and wherein the guide ribs are disposed uprightly at predetermined intervals on the opening in order to guide the air through the opening and toward the laser scanning unit.

7. The cooling unit according to claim 6, wherein the upper plate of the support frame has a smaller surface area than the lower plate, such that the airflow generated by the fan is directed straight towards the laser scanning unit.

8. The cooling unit according to claim 2, wherein the guide ribs that are located on the side of the support frame farthest from the fan are longer than the other guide ribs located closer to the fan.

9. The cooling unit according to claim 8, wherein the guide ribs that are longer than the other guide ribs are disposed on a greater slant relative to the support frame than the other guide ribs.

10. The cooling unit according to claim 1, wherein the airflow is directed towards a side of the support frame opposite the fan, and contacts a bottom of the laser scanning unit directly.

11. The cooling unit according to claim 10, wherein a part of the airflow, which is reflected from the bottom of the laser scanning unit, is directed towards the image development part.

12. The cooling unit according to claim 11, wherein the image development part comprises a casing and components supported within the casing, the airflow directed towards the image development part cooling the casing and the components.

13. The cooling unit according to claim 12, wherein the components comprises a print material volume regulating member.

14. The cooling unit according to claim 13, wherein the airflow moves to the print material volume regulating member of the image development part.

15. The cooling unit according to claim 1, wherein the image development part comprises a print material volume regulating member, and the airflow is directed towards inside the image development part to cool the print material volume regulating member.

16. A cooling unit, to cool a laser scanning unit and an image development part comprising an image development cartridge in an image forming apparatus, the image development cartridge having an organic photoconductor installed inside a printer housing, which develops an image, the image forming apparatus further comprising a laser scanning unit, which scans a surface of the organic photoconductor, and a fuser assembly, which fixes the image transferred from the image development part on a print medium, the cooling unit comprising:

a fan, which generates airflow at the time of operation of the image forming apparatus;

a support frame installed inside the housing, to support the laser scanning unit; and a guide member, disposed on the support frame, to guide the airflow generated by the fan towards the laser scanning unit and the image development cartridge, wherein the guide member comprises a plurality of guide ribs to guide the airflow generated by the fan towards the image development part and the laser scanning unit.

17. The cooling unit according to claim 16, wherein the guide member and the support frame are integrally formed.

18. The cooling unit according to claim 16, wherein the support frame is disposed between the laser scanning unit and the fuser assembly.

19. The cooling unit according to claim 16, wherein the fan is installed on one side of the support frame so as to produce the airflow as being directed toward the opposite side of the support frame.

20. The cooling unit according to claim 16, wherein the guide ribs have varying lengths.

21. The cooling unit according to claim 16, wherein the guide ribs each includes a curved guide surface to guide the air.

22. The cooling unit according to claim 21, wherein the guide surfaces have varying degrees of curvature.

23. The cooling unit according to claim 16, wherein the support frame comprises an opening between an upper plate and a lower plate, and the guide ribs are disposed uprightly at predetermined intervals on the opening in order to guide the air through the opening towards the image development part.

24. The cooling unit according to claim 23, wherein the upper plate of the support frame has a smaller surface area than the lower plate, such that the airflow generated by the fan is directed straight towards the laser scanning unit.

25. The cooling unit according to claim 16, wherein the guide ribs that are located on the side of the support frame farthest from the fan are longer than the other guide ribs located closer to the fan.

26. The cooling unit according to claim 25, wherein the guide ribs that are longer than the other guide ribs are disposed on a greater slant relative to the support frame than the other guide ribs.

27. The cooling unit according to claim 1, wherein the airflow generated by the fan moves inside the image development part.

28. An image forming apparatus, comprising an image development part, which is installed in a housing of the image forming apparatus, and which has an organic photoconductor installed therein;

a laser scanning unit to scan the organic photoconductor;

a fuser assembly to fix an image received from the image development part onto a print medium; and a cooling unit to cool the laser scanning unit and the image development part, comprising:

a fan, which is installed in the housing, and which generates an airflow at the time of operation;

a support frame installed in the housing, which supports the laser scanning unit; and a guide member disposed on the support frame, which guides the airflow generated by the fan into the laser scanning unit and the image development part, wherein the fan is installed on one side of the support frame so as to produce the airflow as being directed toward the opposite side of the support frame.

29. The image forming apparatus according to claim 28, wherein the cooling unit is installed between the laser scanning unit and the fuser assembly.

30. The image forming apparatus according to claim 28, wherein the guide member is integrally formed with the support frame.

31. The image forming apparatus according to claim 28, wherein the support frame is disposed between the laser scanning unit and the fuser assembly.

32. The image forming apparatus according to claim 28, wherein the guide member comprises a plurality of guide ribs disposed at predetermined intervals along the support frame, which guide the airflow generated by the fan toward the image development part and the laser scanning unit.

33. The image forming apparatus according to claim 32, wherein the guide ribs have varying lengths.

34. The image forming apparatus according to claim 32, wherein the guide ribs each includes a curved surface to guide the air.

35. The image forming apparatus according to claim 34, wherein the guide surfaces have varying degrees of curvature.

36. The image forming apparatus according to claim 32, wherein the support frame comprises an opening between an upper plate and a lower plate; and the guide ribs are disposed at predetermined intervals on the opening in order to guide the air through the opening towards the image development part.

37. The image forming apparatus according to claim 36, wherein the upper plate has a smaller surface area than the lower plate.

38. The image forming apparatus according to claim 32, wherein the guide ribs located farthest from the fan are longer than the other guide ribs located closer to the fan.

39. The image forming apparatus according to claim 38, wherein the guide ribs that are longer than the other guide ribs are disposed on a greater slant relative to the support frame.

40. The image forming apparatus according to claim 28, wherein the image development part comprises a print material volume regulating member and the cooling unit cools the print material volume regulating member of the image development part.

* * * * *